United States Patent [19]

Drucker

[11] Patent Number: 4,924,647

[45] Date of Patent: May 15, 1990

[54] EXTERIOR WALL PANEL DRAINAGE SYSTEM

[75] Inventor: Oscar Drucker, Bethpage, N.Y.

[73] Assignee: E. G. Smith Construction Products Inc., Pittsburgh, Pa.

[21] Appl. No.: 393,377

[22] Filed: Aug. 7, 1989

[51] Int. Cl.[5] ..... E04H 1/00

[52] U.S. Cl. ..... 52/235; 52/533; 52/546; 52/478

[58] Field of Search ..... 52/235, 533, 534, 546, 52/547, 97, 209, 478

[56] References Cited

U.S. PATENT DOCUMENTS

| | | | |
|---|---|---|---|
| 3,734,550 | 5/1973 | Vance | 52/235 X |
| 4,055,923 | 11/1977 | Biebuyck | 52/235 |
| 4,184,301 | 1/1980 | Anderson et al. | 52/478 |
| 4,316,351 | 2/1982 | Ting | 52/478 X |
| 4,471,584 | 9/1984 | Dietrich | 52/235 X |
| 4,611,447 | 9/1986 | Krechel | 52/235 X |
| 4,672,784 | 6/1987 | Pohlar | 52/235 |
| 4,683,693 | 8/1987 | Rockar et al. | 52/235 X |
| 4,700,520 | 10/1987 | Ting | 52/478 |
| 4,765,107 | 8/1988 | Ting | 52/533 X |
| 4,840,004 | 6/1989 | Ting | 52/235 |

*Primary Examiner*—David A. Scherbel
*Assistant Examiner*—Creighton Smith
*Attorney, Agent, or Firm*—William J. Ruano

[57] ABSTRACT

A drainage system for draining rain water and internal moisture from the rear of exterior wall panels so as to effectively drain such rain water and moisture outwardly to the outside of the wall panels. The system inlcudes a vertical sealant joint behind adjoining exterior wall panels to sealingly space the wall panels from their support. The space includes foam back-up tapes, vertical sealant, drain tubes, and gutters so arranged as to effectively drain, outside the walls, through weep holes, rain water as well as moisture that tends to accumulate behind the walls. The present system drains both the vertical and horizontal joints of exterior wall panels.

9 Claims, 4 Drawing Sheets

EXTERIOR WALL PANEL DRAINAGE SYSTEM

BACKGROUND OF THE INVENTION

Attempts have been made in the past to drain rain water and moisture from exterior wall panel systems but they have not met with success in accomplishing this task. Present industry practice is to apply sealant to the face of the support system, then squeeze it to a thin film when the panel is placed snuggly against the support. This thin sealant bead breaks down easily when any of the components of the system moves thermally or due to settlement.

SUMMARY OF THE INVENTION

An object of the present invention is to overcome the above-mentioned disadvantages. It relates to a drainage system for draining rain water and internal moisture from the rear of exterior wall panels so as to effectively drain such rain water and moisture outwardly to the outside of the wall panels. The system includes a vertical sealant joint behind adjoining exterior wall panels to sealingly space the wall panels from their support, the space including foam back-up tapes, vertical sealant, drain tubes, and gutters so arranged as to effectively drain, outside the walls, through weep holes, rain water as well as moisture that tends to accumulate behind the walls. The present system drains both the vertical and horizontal joints of exterior wall panels.

DESCRIPTION OF THE PREFERRED EMBODIMENTS

Figure 1:
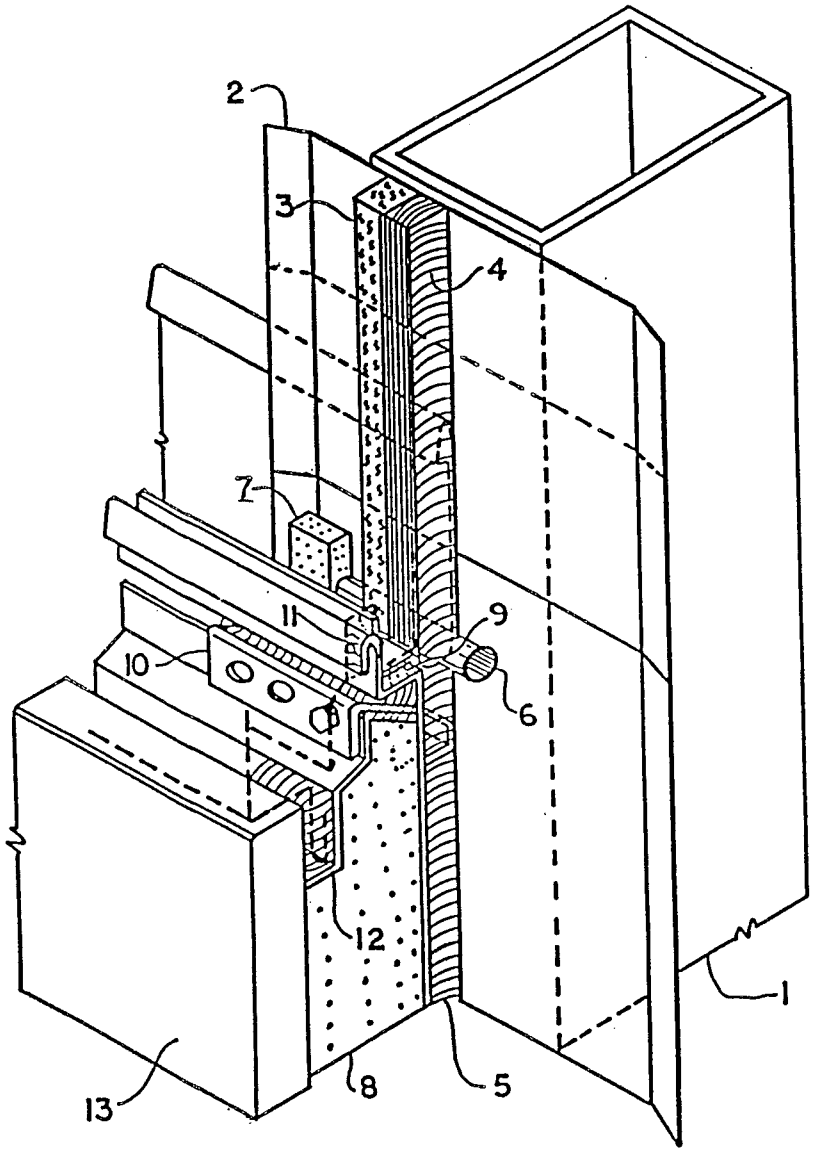
FIG. 1 is a perspective view showing one of the adjoining panels cut away so as to better illustrate the rear drainage system for draining rain water and moisture in accordance with the present invention.

Referring more particularly to FIG. 1 of the drawings, which is a cut away perspective view of the drainage system of the present curtain wall invention, numeral 1 denotes a support mullion having attached to one side thereof, a back-up flash or flashing 2 of metal or plastic, against which there is supported a vertical extending foam back-up tape 3 sealed on one side by a continuous silicone sealant 4 of about ⅜ inch thickness which may be "tooled in" from the outside to serve as a side dam for drainage water and providing the primary seal. This serves as a substantial improvement over formerly used thin film, mashed in place seals.

A horizontal drain tube 6 of plastic or other suitable material is provided at each end with an open cell foam baffle 7, an insulating panel 8, such as one of rigid polyisocyanurate, having an outer metal covering 13, an inner metal covering 9 and an anchor clip and fastener 10 covered by a sealant 11 and including an end dam 12 of silicone or other suitable sealing material.

Figure 2:
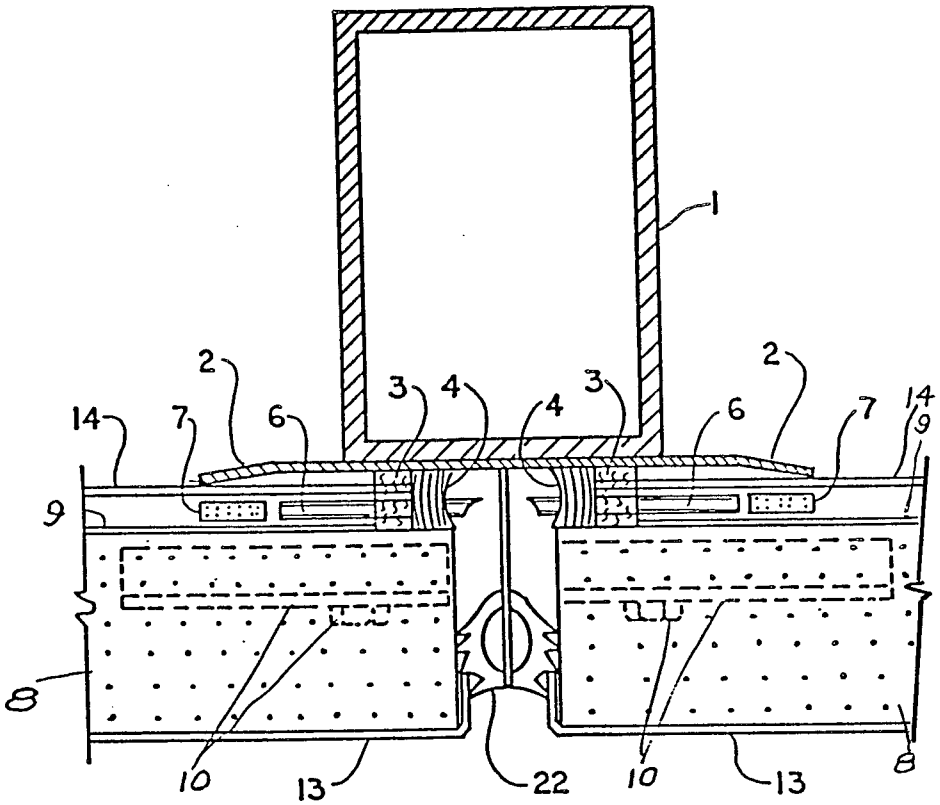
FIG. 2 is a top view thereof showing both adjoining panels.

It will be understood, by reference to FIG. 2, that a second foam back-up tape 3, sealant 4, baffle 7, drain tube 6 and gutter 14 are provided for the panel to the right.

Figure 3A:
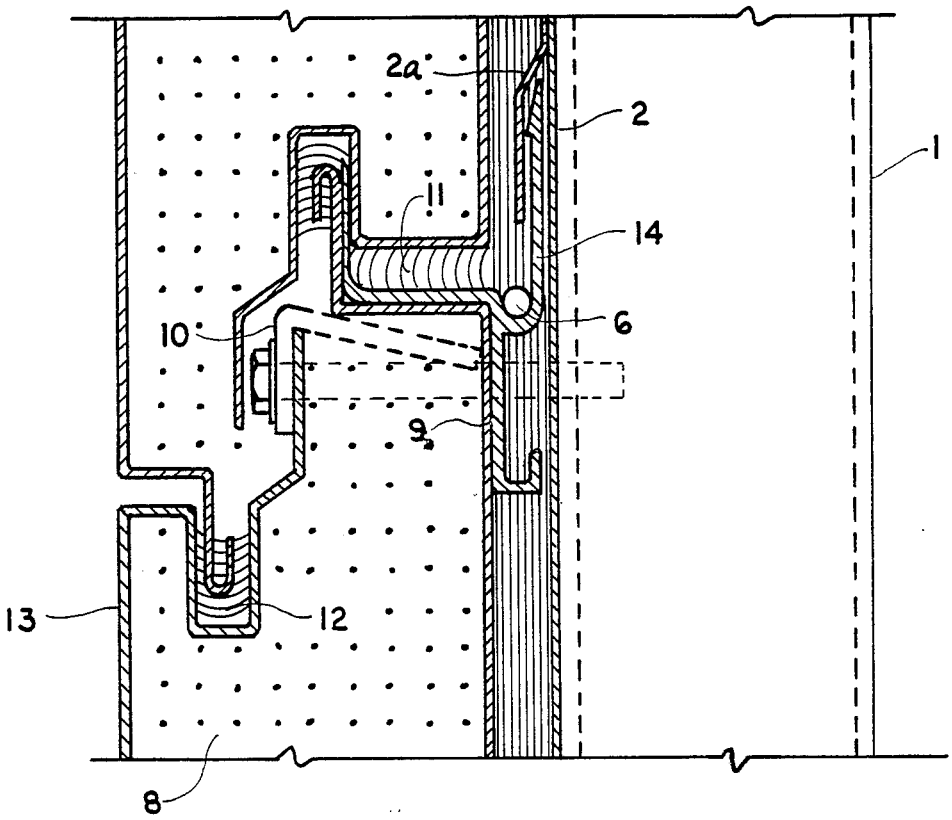
FIGS. 3*a* and 3*b* are vertical cross-sectional views of the left panel of FIGS. 1 and 2.
Figure 3B:
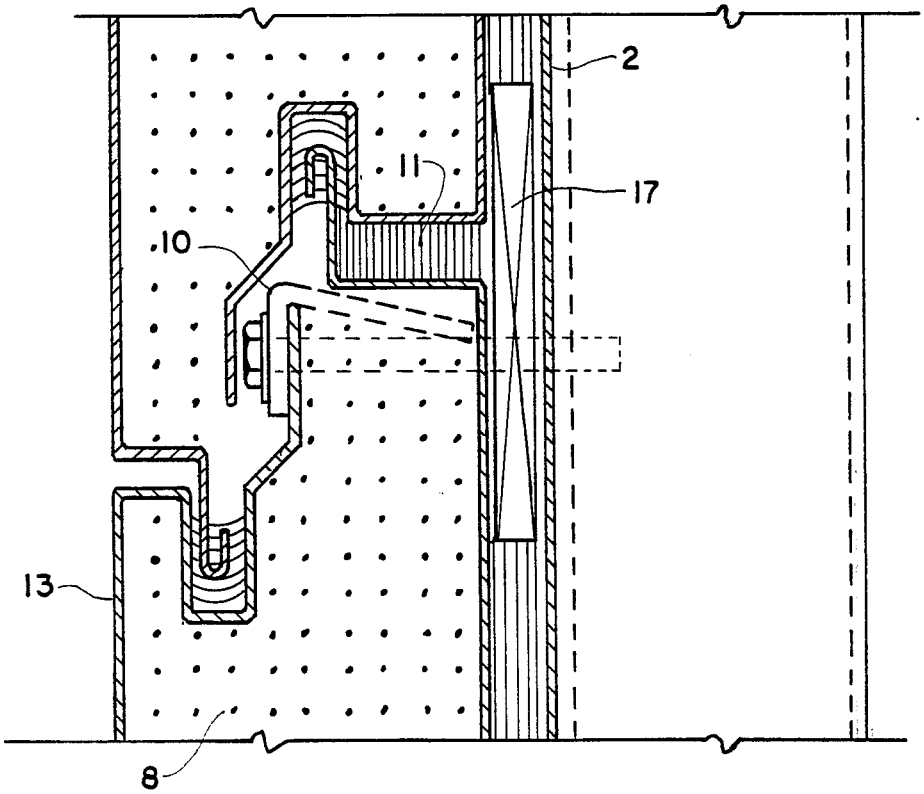

Referring to FIG. 3*a*, it will be noted that the back-up flashing 2 has a portion 2*a* which tucks into a continuous extruded aluminum gutter 14, provided in one panel joint per floor in those areas with no windows. Tube 6 rests in an extruded aluminum gutter 14 extending throughout the width of the panel to provide secondary drainage. In FIG. 3*b*, a spacer 17 is provided between panel 8 and mullion 1.

The internal secondary drainage gutter 14 will drain to the exterior face of the wall any potential water entering at joints and/or any condensation occurring within the wall construction. Weep holes which will be concealed will drain the condensation to the outside panel wall 13.

It is preferred that the extruded aluminum gutter 14 be sealed to the panel system and by nesting it within the joint system, it is automatically sealed continuously when the panel above, shown in dash lines, is put into place, and the gutter's edge is continuously sealed throughout when it enters into the factory-applied sealant 4 within the female pocket.

In operation, water such as rain water or moisture descending on the outer face of back-up flashing 2, will be diverted by the tucked in portion 2*a* and the rear wall of panel 8 towards the drain tube 6 and gutter 14. Rain water entering from the outside of wall panel 8 will be arrested by sealant 12 which serves as a rain screen. As shown in FIG. 2, the vertical joint rain screen gasket 22 is intended to prevent entry of rain water between the wall panels; however, if leakage occurs, it will be guided by the back-up flash 2 and its tucked in portion 2*a* into the horizontal gutters 14.

Water leakage from back-up flash 2 entering open cell foam baffles 7 will enter the drain tubes 6 and drip downwardly between adjoining panels and will be sealed in by rain screen gasket 2 (FIGS. 1 and 2). If leakage occurs due to failure of the back sealant at the panel back face or the marriage bead or gasket 22, water will hug back of the panel and drain into the gutter 14, then drain out through the weep holes. Such drain tube 6 is provided in panel-to-panel gutters only. In the lower part or FIG. 3*b* showing a typical panel side joint, leakage moving down vertically to the sealant will hug back of the panel or be guided by the back-up flashing 2 into the gutter system.

Figure 4A:
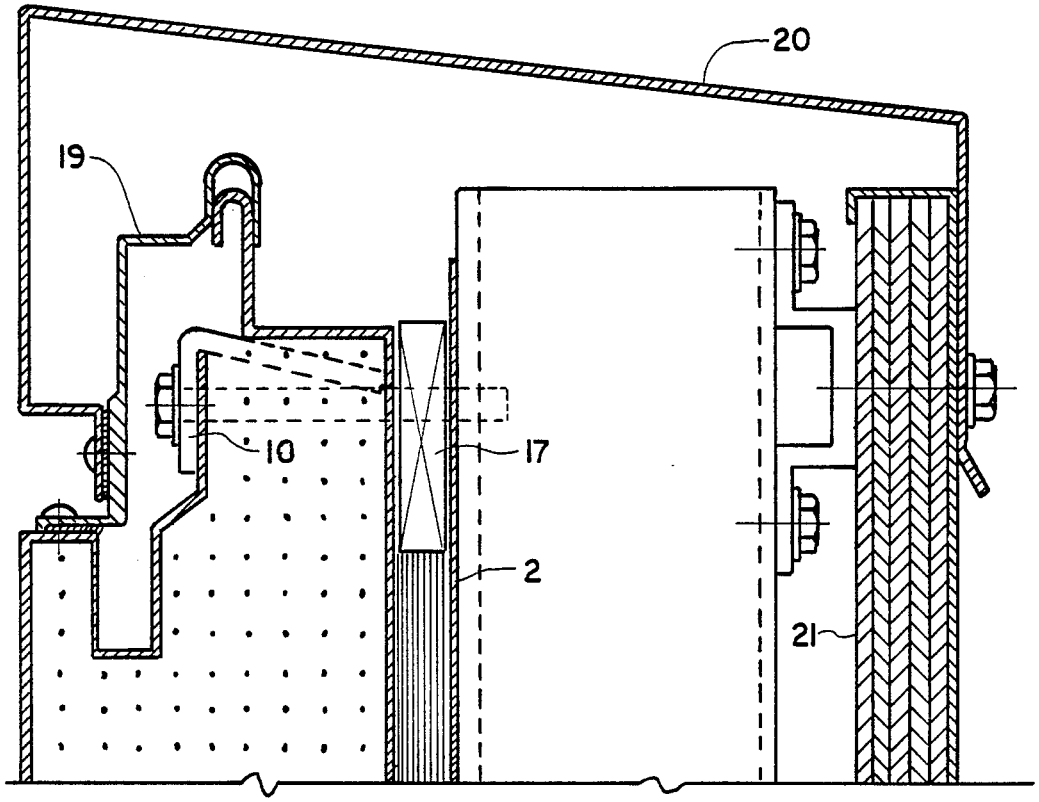
FIGS. 4*a* and 4*b* comprise a vertical cross-sectional view of a panel module modification including a coping and base trim but not including a gutter or drain tube.

FIG. 4*a* shows an upper portion of the wall panel which is provided with an extruded coping anchor 19 on which is mounted a formed metal coping 20, which may have an inner layer of 20 mil vinyl membrane (not shown) extending to the parapet back-up and roofing materials 21.

Figure 4B:
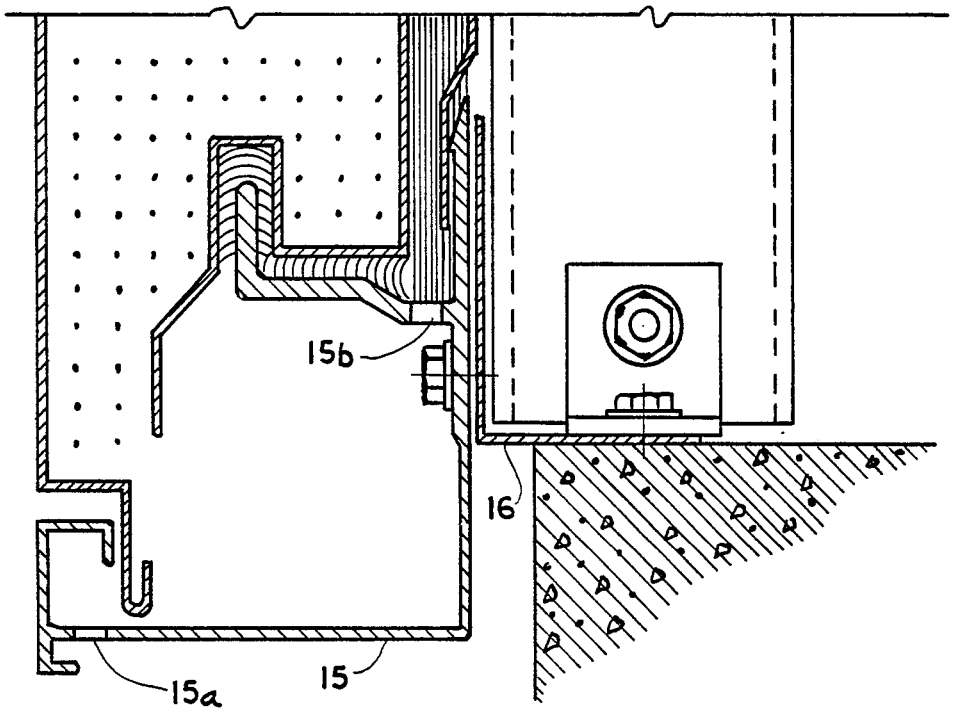

FIG. 4*b* shows extruded base trim 15 set into the sealant which extends vertically along the back-up flashing 2. Weep holes 15*b*, 15*a* will conduct any leakage away from the building.

Figure 5A:
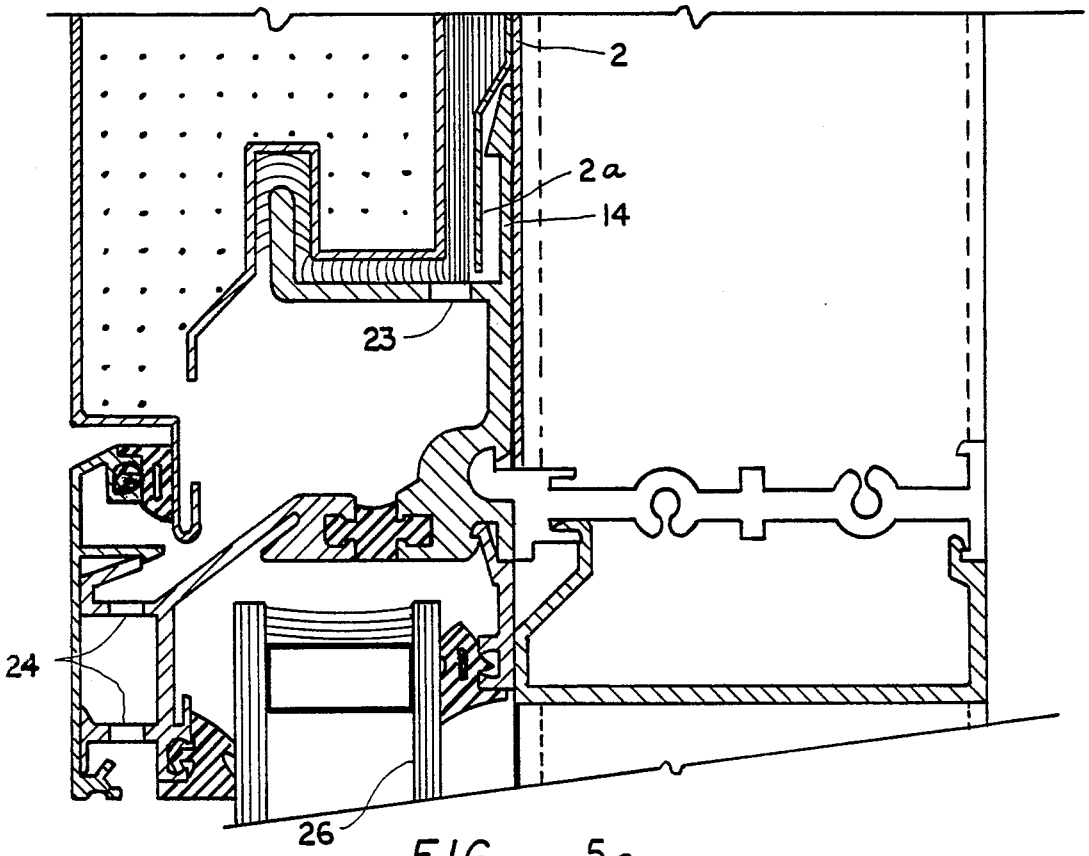
FIGS. 5*a* and 5*b* comprise a vertical cross-sectional view showing a drainage system for the head and seal of a window.
Figure 5B:
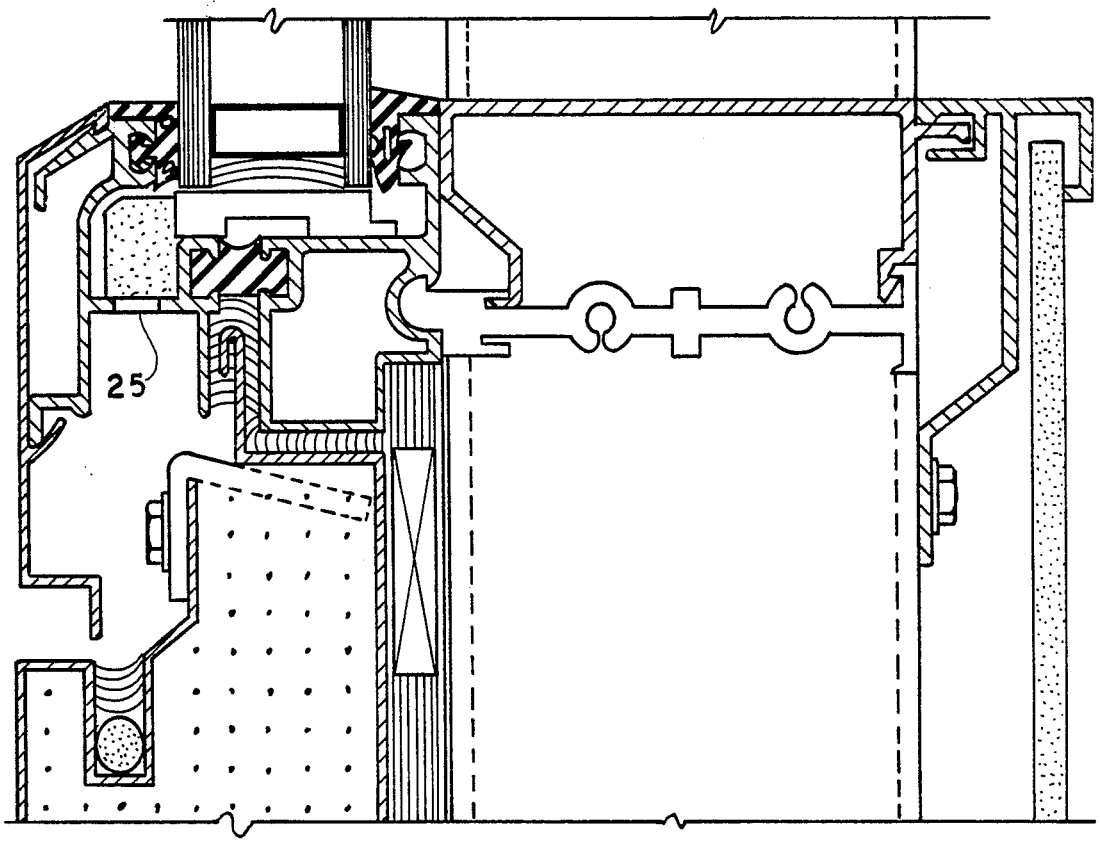

FIGS. 5*a* and 5*b* shows portions above and below the window module. Any potential moisture or condensation will be guided by the back-up flashing 2 tucked at 2*a* into the gutter 14 and will be drained out through the lowermost weep holes 23, in turn, to the weep holes 24 spaced towards the front of the exterior wall panel. Likewise, any drainage from the bottom of the window 26 will flow through the weep hole 25 and flow outwardly to the front of the building panel.

Thus, effective drainage is provided in both the horizontal and vertical panel joints, a unique feature. Moreover, a continuous gutter or flashing is provided around the building perimeters, usually at every window head or floor level for the purpose of draining infiltrated moisture and condensation. Such moisture will weep from the gutter at vertical joint lines or baffled weep holes in window heat extrusions.

The curtain wall of the present invention and window framing systems are thus designed to provide for such expansion and contraction of component materials, as will be caused by an ambient temperature range of 150 degrees without causing buckling, stresses on glass, failure of joint seals, undue stress on structural elements, damaging loads on fasteners, reduction of performance, or other detrimental effects.

Thus it will be seen that a complete drainage system is provided by the present invention, including tubes, gutters and weep holes to completely rid the interior of the building of any rain water or moisture from condensation and drain it to the outside of the exterior panel system.

I claim:

1. In an exterior wall assembly comprising insulated wall panels, each having a core of insulating material covered with inner and outer metal coverings which are interfitted vertically by horizontal joints; the improvement comprising a vertically extending back-up flashing mounted on the side of a support mullion, fastening means and a spacer for mounting said wall panels on said back-up flashing and mullion in horizontally spaced relationship therewith with the sides of a pair of said panels spaced apart, forming a vertical gap therebetween, a gasket bridging said sides to form a vertical joint rain screen to prevent entry of rain water between said sides, horizontally extending gutters of substantially U-shape cross-section for channeling water horizontally in said gap between said back-up flashing and the inner metal coverings of said pair of panels, said gutters terminating short of said sides, a vertically extending strip of sealant adjacent the terminal ends of said gutters on each of said sides to serve as side dams for draining water and providing a primary seal, drain tubes lying in said gutters and extending through said vertically extending sealants to drain said gutters downwardly of said vertical joint.

2. The exterior wall assembly recited in claim 1 together with a vertically extending strip of foam back-up tape adjoining each sealant throughout its length above said gutters, and open cell baffles in said gutters adjacent draining ends of said drain tubes.

3. The exterior wall assembly recited in claim 1 wherein said flashing has an integral portion tucked into said gutters for draining therein water leakage from the surface of said back-up flashing.

4. The exterior wall assembly recited in claim 3 wherein said gasket is mounted on said back-up flashing.

5. The exterior wall assembly recited in claim 1 together with a base trim attached to the bottom of at least one of said panels with concealed weep holes in said base trim staggered in a downward and outward direction for draining leakage outwardly of said one of said panels.

6. An exterior wall assembly as recited in claim 1 together with a coping covering the top portion of said assembly, being attached at one end to the front of the uppermost insulated wall panel and being attached at the other end to the rear of said support mullion.

7. In an exterior wall assembly comprising wall panels, each having a core of insulating material covered by inner and outer metal coverings which are interfitted vertically by horizontal joints; the improvement comprising a vertically extending support mullion of substantially rectangular cross-section, anchor clip and fastener means extending through said core and said outer and inner metal coverings of two of said panels which are spaced apart sidewise for mounting said panels with their side walls in horizontally spaced relationship with said support mullion to form a first gap, a vertically extending strip of sealant bridging said first gap at each side of said two spaced apart panels, a pair of gutters in said first gap, one behind each of said two panels with ends adjacent said sealant strips, a pair of drain tubes, one lying in each gutter and extending through the corresponding strip of sealant for draining water downwardly, said two sidewise spaced apart panels forming a second gap into which said drain tubes drain, and a vertical joint rain screen gasket bridging said second gap.

8. The exterior wall assembly recited in claim 7 together with a strip of back-up foam backing each of said strips of sealant, the bottom portions of said two panels having a metal covering with weep holes staggered downwardly and outwardly of said panels.

9. The exterior wall assembly recited in claim 8 together with a coping covering the top portion of said assembly, being attached at one end to the front of the uppermost insulated wall panel and being attached at the other end to the rear of said support mullion.

* * * * *